United States Patent [19]

Anderson et al.

[11] 4,087,043

[45] May 2, 1978

[54] DUAL SEAL ARRANGEMENT FOR A CENTRIFUGE ROTOR TUBE CAVITY

[75] Inventors: Roger Bruce Anderson, San Jose; John Robert Edwards, Mountain View, both of Calif.

[73] Assignee: Beckman Instruments, Inc., Fullerton, Calif.

[21] Appl. No.: 715,117

[22] Filed: Aug. 17, 1976

[51] Int. Cl.[2] ..... B04B 5/00

[52] U.S. Cl. ..... 233/26; 233/1 A

[58] Field of Search ..... 233/26, 27, 1 R, 1 A; 23/292; 210/DIG. 23, DIG. 24; 285/52, 54; 277/206 R

[56] References Cited

U.S. PATENT DOCUMENTS

| | | | |
|---|---|---|---|
| 2,816,704 | 12/1957 | Skarstrom | 233/1 R |
| 3,133,882 | 5/1964 | Mitchell et al. | 233/26 |
| 3,366,320 | 1/1968 | Cho | 233/26 |
| 3,459,369 | 8/1969 | Marks | 233/26 |
| 3,938,735 | 2/1976 | Wright et al. | 233/26 |
| 3,998,383 | 12/1976 | Romanauskas | 233/26 |

FOREIGN PATENT DOCUMENTS

| | | | |
|---|---|---|---|
| 1,237,860 | 6/1960 | France | 285/52 |
| 864,410 | 4/1961 | United Kingdom | 233/26 |

*Primary Examiner*—George H. Krizmanich
*Attorney, Agent, or Firm*—Robert J. Steinmeyer; Ferd L. Mehlhoff; William H. May

[57] ABSTRACT

A dual seal arrangement for use in a rotor to ensure the retention of the fluid sample within the test tube cavity during high speed centrifugation in an ultracentrifuge. The dual seal arrangement provides not only a seal on the test tube within the rotor tube cavity, but also a seal on the rotor tube cavity itself. One seal provides a capping arrangement on the test tube to securely seal the fluid sample within the test tube which rests within the rotor tube cavity. A secondary seal is positioned within the rotor tube cavity above the capping seal to provide a complete seal of the rotor tube cavity above the test tube.

1 Claim, 5 Drawing Figures

DUAL SEAL ARRANGEMENT FOR A CENTRIFUGE ROTOR TUBE CAVITY

BACKGROUND OF THE INVENTION

The present invention relates generally to test tube sealing caps used in centrifuge rotors and, more particularly, is related to sealing arrangements used for not only sealing test tubes, but also sealing the rotor tube cavity in which the test tube resides.

Analytical and comparative centrifuges are commonly provided with a rotor having a series of cavities which are arranged in a generally circular orientation for receipt of test tubes carrying a sample to be centrifuged. In many prior art rotor cavity arrangements the axis of each cavity is annularly oriented with respect to the vertical rotational axis of the rotor, so that the bottom of the test tube is further away from the rotor axis than the top. An example of such an annularly oriented rotor cavity rotor is shown in FIG. 5 of U.S. Pat. No. 2,878,992 issued to Pickels et al. on Mar. 24, 1959 and assigned to the assignee of the present invention.

During centrifugation the sample, which is initially in the lower end of the test tube, attains a somewhat vertical orientation which is essentially parallel to the rotor axis. Because of the orientation of the test tube in the rotor a portion of the sample reaches the upper end of the test tube and exerts a significant amount of loading on the capping arrangement at the upper end of the test tube. Consequently, because of the high G forces experienced by the test tube capping arrangement, it is extremely important to design a sealing arrangement on the test tube to retain the sample fluid within the test tube and prevent possible escape of the fluid from the rotor which may cause a serious imbalance in the rotor, resulting in serious damage not only to the rotor but to the drive system.

An exemplary solution to the particular problem of sealing the upper end of the test tube is shown in U.S. Pat. No. 3,938,735 issued to Wright et al. on Feb. 17, 1976 and assigned to the assignee of the present invention. This patent discloses the use of a test tube cap assembly which deforms inwardly the flexible test tube at its upper end to squeeze the upper end of the tube between respective slanting surfaces of the stem member and the crown member to effect a fluid tight seal. Another approach to sealing the upper end of the test tube is shown in U.S. Pat. No. 3,447,712 issued to M. Galasso, et al. on June 3, 1969 and assigned to the assignee of the present invention. This patent discloses the use of a crown member and a stem member in conjunction with an O-ring to seal the top of the test tube.

Recently, however, rotors have been designed which incorporate a series of vertical tube cavities oriented in a circular fashion around the rotational axis of the rotor. In such a configuration the sealing of the test tube sample within the tube itself as well as within the rotor becomes extremely critical, since even a greater amount of the fluid sample will be exerting higher centrifugally induced forces on the upper end of the test tube during centrifugation than in fixed angle tube rotors. Typically, the type of test tube utilized is a thin flexible material which in some instances may have a weak point which under the high G loading exerted by the fluid could result in possible leakage, allowing fluid to escape out of the rotor and resulting in possible damage to the rotor.

SUMMARY OF THE INVENTION

The present invention discloses a dual seal arrangement for a rotor having a series of rotor test tube cavities wherein one seal is designed for capping the open end of the test tube located within the rotor cavity and the second seal is designed to enclose the open end of the rotor tube cavity about the first seal and the test tube. The secondary seal utilizes a sealing element which acts in cooperation with a holding member that is movable into engagement with the sealing element to compress it against the cavity surface to provide a seal over the first seal or capping means of the test tube.

In one embodiment, the sealing element is a ring with two inward flanges, so that the sealing element will engage the crown member on the capping means for the test tube. A threadable plug presses down on the sealing ring and against the crown member to cause a seal not only between the plug and the crown member, but also between the crown member and the cavity surface. In an alternate embodiment, a sealing ring is placed around a shoulder of a counterbored area within the cavity above the test tube and the threadable plug is moved into engagement with the sealing ring to compress it between the plug and the shoulder of the cavity to seal the cavity above the test tube.

The present invention, therefore, provides a secondary seal which will contain within the cavity any of the fluid sample which may possibly lead from the test tube itself as a result of a possible misassembly of the tube capping means by a technician or as a result of a possible failure in the thin flexible test tube itself. Hence, containment of the fluid sample in the rotor cavity is assured, alleviating the possibility of any escape of the fluid sample from the rotor which could cause an imbalance to the rotor, resulting in possible damage or destruction of both the rotor and the drive system. A unique advantage of the secondary sealing ring used in conjunction with the crown member of the test tube capping arrangement is that the placement of the sealing ring on the crown member facilitates easy assembly and operation of the rotor. Consequently, the technician does not have to install or spend time adjusting a secondary seal mounted in the rotor tube cavity or worry about lubricating the seal.

DETAILED DESCRIPTION OF THE INVENTION

Figure 1:
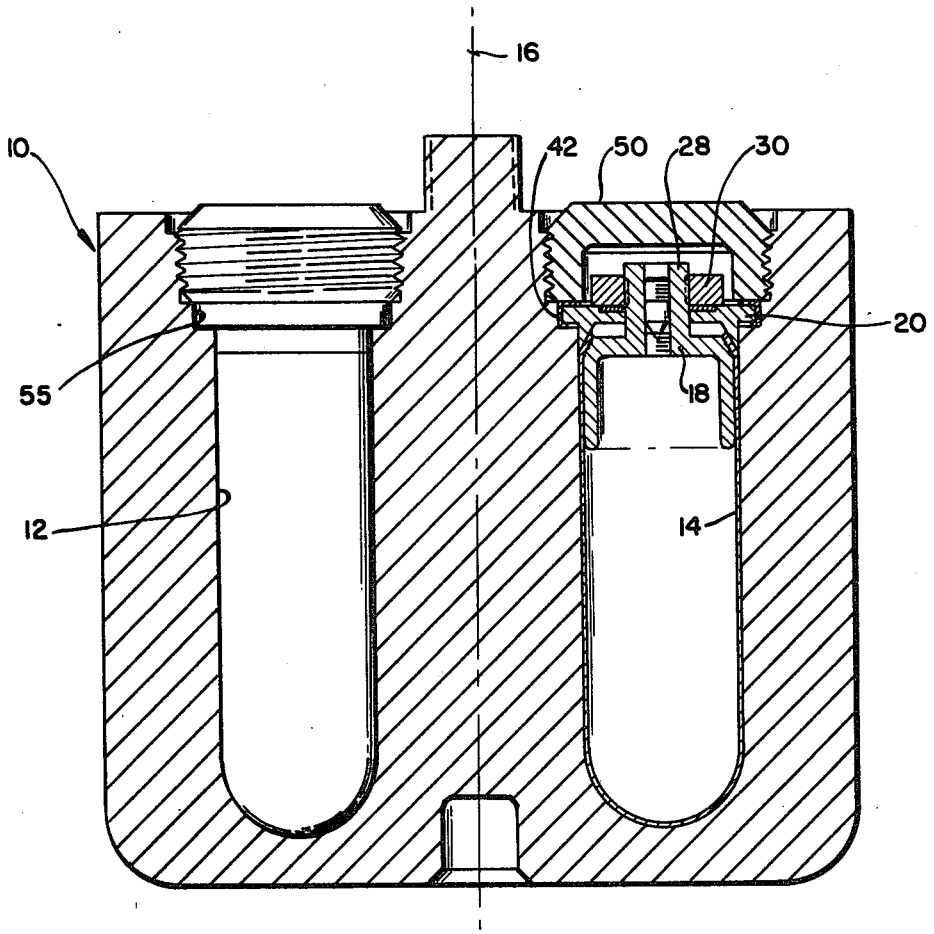
FIG. 1 is a vertical sectional view of a vertical tube preparative centrifuge rotor showing a test tube and dual seal arrangement of the present invention.

In FIG. 1 a vertical tube rotor 10 is shown having rotor cavities 12 into which are situated flexible test tubes 14. It should be noted that in the vertical tube rotor the rotor cavities 12 are positioned to be essentially parallel with the rotor axis 16. The capping assembly for the test tube disclosed in the above-referenced U.S. Pat. No. 3,938,735 is similar to the capping assembly or test tube seal arrangement 17 shown in FIG. 3, having a stem member 18 and a crown member 20 with respective opposing and mating frustoconical surfaces 22 and 24 which are designed to engage the upper end 26 of the flexible test tube 14. The stem member 18 has a stud 28 that threadably receives the threaded clamping nut 30 which, when tightened down against the crown member 20, causes the frustoconical surface 22 of the stem member to tightly press the upper end 26 of the test tube against the frustoconical surface 24 of the crown member to tightly seal the open end of the test tube. Located within the stud 28 of the stem member 18 is a threaded aperture 31 for receipt of an insert member 32 and a sealing screw 34. The insert 32 has an aperture 36 through which the fluid sample may be inserted or removed while the screw 34 is used to seal the aperture 36. Further detail with respect to the configuration and operation of the capping or sealing assembly 17 for the test tube 14 can be found with reference to U.S. Pat. No. 3,938,735.

Figure 2:
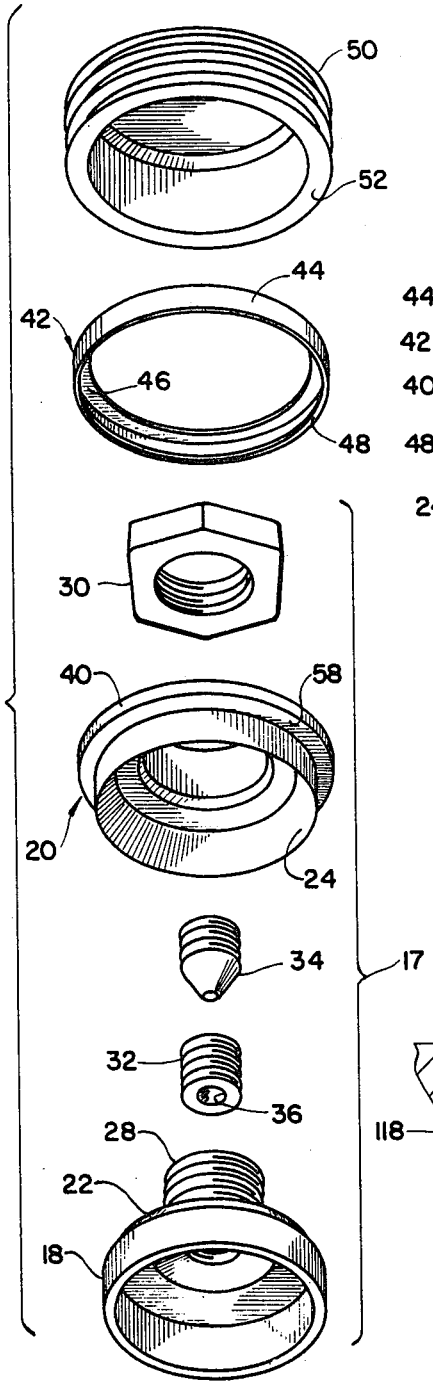
FIG. 2 is a perspective exploded view of the dual seal arrangement for the test tube and rotor cavity.
Figure 3:
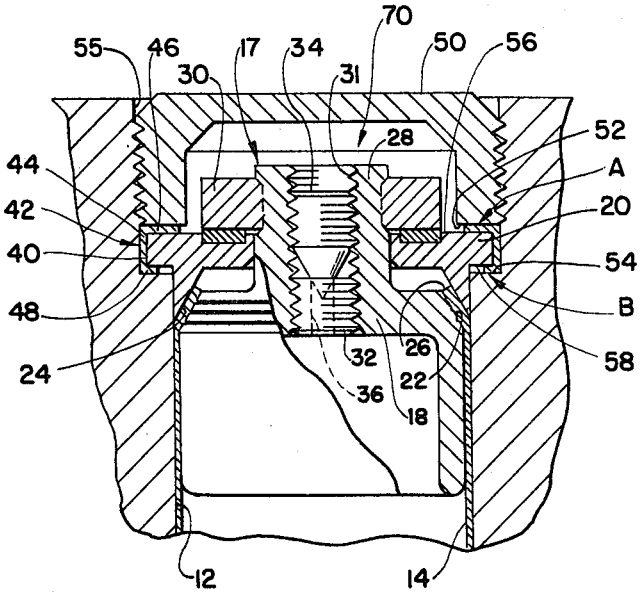
FIG. 3 is an enlarged sectional view of the present invention of a dual seal arrangement positioned within the rotor cavity.

Attention is directed to FIGS. 2 and 3, showing the present invention used in conjunction with the capping assembly 17. Positioned adjacent the outside cylindrical surface 40 of the crown member 20 is a sealing element 42 having a generally cylindrically shaped main portion 44 with an upper inward circular flange 46 and a lower inward circular flange 48. The sealing element is made of a somewhat pliable material such as Delrin, so that it will snap over the outer portion of the crown member 20 adjacent its outer cylindrically shaped surface 40 where the sealing element 42 will remain securely positioned throughout its useful life.

Threadably mounted above the capping assembly 17 is a sealing plug 50 which is designed to move a bearing surface 52 toward and away from the sealing element 42. When the bearing surface 52 of the plug 50 is adjacent the sealing element 42, the upper inward circular flange 46 of the sealing element 42 is positioned between the plug 50 and the crown member 20 while the lower inward circular flange 48 is positioned between the crown member 20 and the shoulder surface 54 of the counterbore portion 55 of the rotor cavity 12. Further, the cylindrical portion 44 of the sealing element 42 is located between the vertical surface of the counterbore portion 55 of the rotor cavity and the outer cylindrical surface 40 of the crown member 20.

With respect to the operational use of the present dual sealing system for the rotor tube cavity the stem member 18 and crown member 20 are secured to the upper end 26 of the flexible test tube 42 in the manner described and explained in the abovereferenced U.S. Pat. No. 3,938,735. The fluid sample is inserted through the center of the stud 28 and aperture 36. The sealing screw 34 is then inserted, resulting in a complete seal of the fluid sample within the test tube. The secondary sealing element 42 is placed on the crown member adjacent its outer cylindrical surface 40 in the manner shown in FIG. 3, so that the upper inner circular flange 46 is on the top surface 56 of the crown member and the lower inward circular flange 48 is positioned between the shoulder surface 54 of the rotor cavity and the lower surface 58 of the crown member 20. The test tube with the capping assembly 17 as well as the sealing element 42 is then placed within the rotor cavity 12 to the position as shown in FIG. 1. The plug member 50 is then inserted into the counterbore area 55 of the rotor cavity 12 and threaded down to the position where the bearing surface 52 contacts the upper inward circular flange 46 of the sealing element 42. The plug is turned tightly to compress the sealing element 42 in such a manner that it is tightly compressed between the plug and the crown member, establishing a sealing junction indicated by arrow A, and is tightly compressed between the crown member and the rotor cavity, establishing another sealing junction indicated by arrow B. Therefore, the rotor cavity above the test tube 14 is sealed tightly to prevent any escape of fluid sample which might inadvertently leak from the test tube.

During the operation of the centrifuge with the vertical tube cavity orientation, tremendous G forces will be exerted by the fluid sample against the upper end of the test tube where the capping assembly 17 has tightly secured the upper end 26 of the test tube. In the event that a technician might improperly secure that crown member to the stem member or improperly seal the center aperture 36 with the sealing screw 34, the centrifugally induced high G forces exerted by the fluid against the capping assembly would cause a leakage of the fluid out of the test tube. Any fluid leaking out of the center aperture area 36 would enter the plug cavity 70. The fluid would then attempt to exit through the junction A between the bearing surface 52 of plug 50 and the upper surface 56 of the crown member 20. However, the existence of the sealing element 42 at junction A will prevent the escape of the fluid from the test tube cavity in the rotor. If the sealing element 42 were not present, the fluid, leaking from the test tube under the high centrifugally induced forces, would escape along the threaded interface between the plug 50 and the upper end of the tube cavity.

The improper attachment or connection between the crown member and the stem member adjacent the upper end 26 of the test tube could also result in some fluid attempting to leak up between the interface of the stud portion 28 of the stem 18 and the crown member 20 and into the plug cavity 70. This fluid would then attempt to escape through the junction A and would be inhibited by the existence of the sealing element 42. Fluid may also attempt to escape through the interface between the crown member 20 and the tube cavity surface in the rotor. However, fluid attempting to escape through this junction between the cavity wall and the crown member would be blocked by the existence of the sealing element 42 at junction B.

In some instances the test tube 14 itself might create a leak through an imperfection in the tube. The escaping fluid will attempt to exit the tube cavity of the rotor along the interface between the tube 14 and the rotor cavity surface 12 up through the interface between the stem member 20 and the cavity wall. However, the existence of the sealing element 42 at junction B will prevent the fluid from exiting the tube cavity within the rotor. Therefore, any fluid leaking from the test tube would be contained within the rotor cavity and be prevented from escape because of the existence of the sealing element 42 and the holding force of the plug 50 which will anchor the sealing element against the tremendous forces exerted by the fluid sample induced from the centrifugation operation. Further, in the event that the test tube itself 14 would experience a leak, the retaining force of the plug 50 against the sealing element 42 in conjunction with the crown member 20 would retain the fluid sample within the rotor tube cavity and prevent its escape which otherwise would possibly cause an imbalance to the rotor, causing damage to both the rotor and the drive system.

Figure 5:
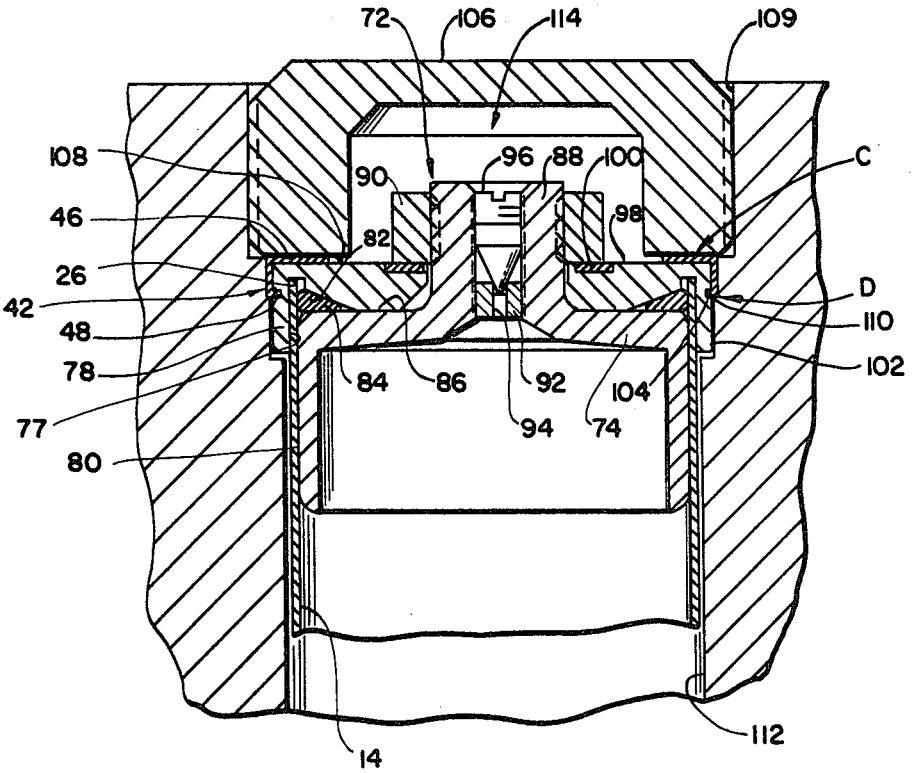
FIG. 5 is an enlarged sectional view of the present invention in combination with an alternate tube capping seal.

FIG. 5 shows the sealing element 42 in an alternate combination with another capping assembly 72, having a stem member 74 and a crown member 76. The crown member has a downward extending outer cylindrical flange 78 which in conjunction with the outer surface 80 of the stem member 74 provides a recess for the receipt of the upper end 26 of the test tube 14. The stem member 76 has an inward slanting recessed lower surface 82 adjacent the outer flange 78. Positioned adjacent this recessed surface 82 is an O-ring 84 which rests on the generally flat upper surface 86 of the stem member 74. The O-ring 84 occupies the majority of the area formed between the upper surface 86 of the stem member, the recessed slanting surface 82 of the crown member, and inside surface of the upper end 26 of the test tube 14. Threadably mounted on the stud portion 88 of the stem member 74 is a threaded tube cap nut 90. Located within the threaded aperture 89 of the stud 88 is an insert member 92 having an access aperture 94. Threaded above the insert member 92 is a sealing screw 96. Positioned within the top surface 98 of the crown member 76 is a crown washer 100 which receives the nut 90 when it is tightened down on the stud 88 against the crown member 76.

When the upper end 26 of the test tube 14 is positioned between the outer surface 80 of the stem member 74 and the interior surface 77 of the downward flange 78 of the crown member 76, the tightening nut 90 is threaded down tightly against the upper surface 98 of the crown member 76. This causes the O-ring 84 to be compressed to produce an outward sealing force against the upper end 26 of the test tube 14. The slanting surface 82 of the crown member 76 directs the O-ring outwardly against the interior surface of the test tube 14 to establish a tight seal between the O-ring on the test tube.

Located on the outer surface 102 of the downward extending flange 78 of the crown member is a slight recessed groove 104 which receives the lower circular inward flange 48 of the sealing element 42. The upper circular inward flange 46 of the sealing element 42 resides on the upper surface 98 of the crown member 76. Positioned above the capping assembly 72 is a plug 106 which is threadably engaged within the rotor cavity 109. When the plug 106 is tightened downwardly with its bearing surface 108 into engagement with the upper inward flange 46 of the sealing element 42, a sealing junction indicated by the arrow C is established between the upper surface 98 of the crown member 76 and the bearing surface 108 of the plug 106.

It should be noted that the cavity 108 has a necked down or small shoulder portion 110 on which resides a portion of the lower inward circular flange 48. Consequently, by having the plug 106 tightened down against the sealing element 42 another sealing junction indicated by the arrow D is established between the sealing element 42 and its contact with the shoulder 110.

If in the operation of the rotor a leakage occurred in the test tube itself due to a defect in the tube, the fluid would attempt to exit the rotor tube cavity along the interface between the test tube 14 and the wall 112 of the rotor cavity up to the point where it would be blocked by the sealing junction D established between the sealing element 42 and the shoulder 110. Furthermore, if the capping assembly 72 were inadvertently misassembled by a technician, some fluid would flow down between the interior surface 77 of the crown member flange 76 and then continue up through the interface between the outer surface 102 of the flange 78 and the cavity wall 112 to the sealing junction D where it would be prevented from escaping the rotor.

On the other hand, in the event that the sealing screw 96 is not correctly positioned within the stem member 74 any fluid leaking out of the stud 88 would enter the plug cavity 114 and attempt to escape from the rotor cavity between the bearing surface 108 of the plug and the top surface 98 of the ground member. However, existence of the sealing element 42 at junction C prevents any escape of the fluid.

Figure 4:
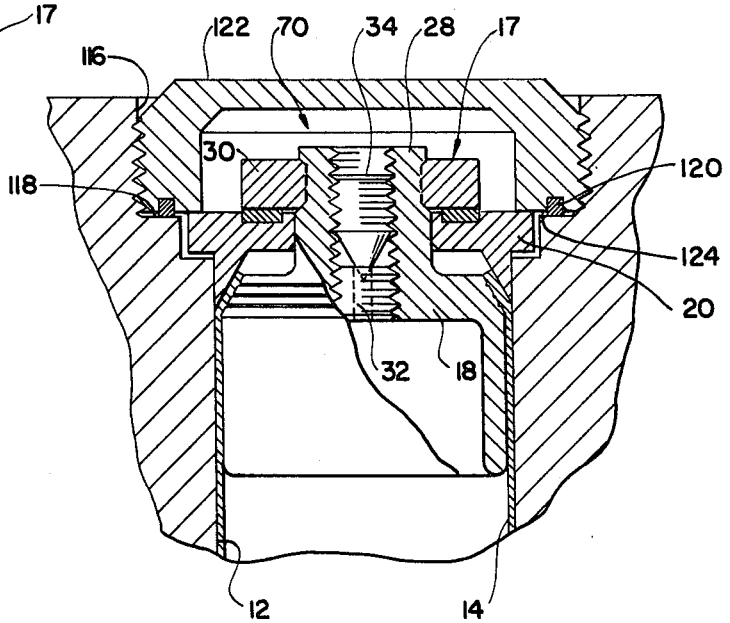
FIG. 4 is an enlarged sectional view of an alternate embodiment of the present invention showing the dual seal arrangement positioned within the rotor cavity.

An alternate embodiment of the present invention is shown in FIG. 4 in conjunction with the capping assembly 17 of FIG. 3 wherein a second counterbore area 116 is positioned within the rotor cavity with a second rotor cavity shoulder 118. Positioned on the shoulder 118 is a sealing element 120 in the form of a circular sealing ring made of a pliable material such as Delrin. A plug member 122 is threadably engaged within the second counterbore area 116 of the rotor tube cavity and has a bearing surface 124 designed to engage the sealing element 120 when the plug is moved down the second counterbore area 116. Further, the bearing surface 124 also contacts the top surface 56 of the crown member 20 to prevent hydrostatic pressure generated in the tube from displacing the tube upwards into the plug cavity 70. When the bearing surface 124 of the plug 122 contacts the sealing element 120, the sealing element is compressed between the bearing surface 124 and the secondary shoulder 118 to present a second sealing area within the tube cavity to prevent the escape of any fluid sample which may inadvertently escape from the test tube. Consequently, an improper placement of the capping assembly 17 onto the test tube 14, resulting in a leakage of the fluid sample out of the test tube, would be contained within the tube cavity by the sealing arrangement of the sealing element 120 and the plug 122 bearing against the shoulder 118 in the rotor cavity.

The plug 50 in the first embodiment shown in FIG. 3, the plug 106 of the alternate combination of FIG. 5, and the plug 122 shown in the alternate embodiment of FIG. 4 not only provide a force to compress the respective sealing elements 42 and 120 in sealing contact between the respective plug and the rotor cavity surface, but also provide a biasing or holding means in the rotor itself to maintain the seal on the cavity against the tremendous opposing forces induced by the fluid sample during centrifugation. Consequently, the plugs 50, 106, and 122 serve as necessary anchoring devices to withstand the possible escaping force of the fluid sample as it creates tremendous centrifugally induced forces against the sealing element and the plug, tending to push them out of the rotor.

While the invention has been described with respect to the preferred physical embodiments, it will be apparent to those skilled in the art that various modifications and improvements may be made without departing from the scope and spirit of the invention.

What is claimed is:

1. A dual seal rotor apparatus comprising:

a rotor having a rotor cavity for receipt of a fluid sample carrying test tube, said cavity having a shoulder;

means recessed within said cavity for capping the open end of said test tube, said capping means establishing a fluid seal around said open end of said tube and having an outside cylindrical rim;

a plug threadably engaged within said cavity above said capping means;

a cylindrical sealing element positioned between said capping means outside cylindrical rim and said cavity;

an upper inward circular flange integral with and extending from said cylindrical sealing element and over the top of said capping means outside cylindrical rim in contacting relation between said plug and said capping means outside cylindrical rim; and a lower inward circular flange integral with and extending from said cylindrical sealing element and below said capping means outside cylindrical rim in contacting relation between said cavity shoulder and said capping means outside cylindrical rim, said lower inward circular flange in conjunction with said plug and said capping means and said tube cavity shoulder forming a first sealing junction, said upper inward circular flange in conjunction with said plug and said capping means forming a second sealing junction, said first and second sealing junctions establishing secondary seals to prevent any of said fluid sample from escaping said rotor when said fluid escapes one of said capping means and said test tube.

* * * * *